US008707473B2

(12) United States Patent
Rane

(10) Patent No.: US 8,707,473 B2
(45) Date of Patent: Apr. 29, 2014

(54) APPARATUS TO ASSIST SQUATTING ON TOILETS

(76) Inventor: Ajay Rane, Aitkenvale (AU)

( * ) Notice: Subject to any disclaimer, the term of this patent is extended or adjusted under 35 U.S.C. 154(b) by 0 days.

(21) Appl. No.: 13/547,644

(22) Filed: Jul. 12, 2012

(65) Prior Publication Data

US 2013/0067649 A1 Mar. 21, 2013

Related U.S. Application Data

(63) Continuation-in-part of application No. 12/734,974, filed as application No. PCT/AU2008/001800 on Dec. 5, 2008, now abandoned.

(30) Foreign Application Priority Data

Dec. 5, 2007 (AU) ..... 2007237353

(51) Int. Cl.
*E03D 11/00* (2006.01)

(52) U.S. Cl.
USPC ..... 4/254

(58) Field of Classification Search
USPC ..... 4/254; 254/93 R, 122
See application file for complete search history.

(56) References Cited

U.S. PATENT DOCUMENTS 5,809,583 A * 9/1998 Pucciani ..... 4/254
6,148,448 A * 11/2000 Urso ..... 4/254

FOREIGN PATENT DOCUMENTS

WO WO 03/016642 2/2003

* cited by examiner

*Primary Examiner* — Lori Baker
(74) *Attorney, Agent, or Firm* — Stein IP, LLC

(57) ABSTRACT

An apparatus for assisting a person in assumption of a beneficial position for evacuations when using a toilet, the apparatus including a platform adapted to raise a user's feet from the ground surface, the platform having at least one height adjustment means associated therewith and an opening therein to at least partially receive a portion of the toilet or bowl.

15 Claims, 15 Drawing Sheets

APPARATUS TO ASSIST SQUATTING ON TOILETS

CROSS-REFERENCE TO RELATED APPLICATIONS

This is a continuation-in-part of U.S. patent application Ser. No. 12/734,974, filed Jun. 7, 2010, in the United States Patent and Trademark Office, which claims the benefit of PCT International Patent Application No. PCT/AU2008/001800, filed Dec. 5, 2008, and Australian Patent Application No. 2007237353, filed Dec. 5, 2007, the disclosures of which are incorporated herein by reference.

BACKGROUND OF THE INVENTION

1. Field of the Invention

The present invention relates generally to devices for maintaining postures or attitudes particularly in bowel and bladder movements or evacuations.

2. Description of the Related Art

The purpose of this invention is to provide the option of 3 positions during toileting:

1. The "correct" position: feet flat, lean forward—for people who cannot squat, for children and others, also called the "Perfect Pee" position.

2. The near squat position: for improved bowel and bladder evacuation in case of lack of flexibility and for children or people unable to squat.

3. The squatting position: a safe, robust piece of equipment to allow "full squatting" safely using existing toilet structures, thus preventing major construction changes.

Virtually every physician and physiologist who has considered the subject agrees that squatting is one of the most natural and physiologically sound postures to use for evacuation.

Recent papers published by Rane et al and Gupta et al. show the benefits of squatting when urinating. Wennergren et al in 1984 have showed the benefits of foot support and leaning forward in children with bladder and bowel problems. Also a recent paper by El-Bahnasawy shows men urinate better in the sitting and leaning forward position than standing. All this research confirms the importance of squatting and foot support during urination in men, women and children.

It has also been proven quantitatively in a research study by Devreese et al., 2000 that irregularities during micturition are less frequent in the forward-bending and anterverted positions and was concluded that the forward bending position is the most preferred urinating position to relax pelvic floor muscles.

There have been attempts in the past to configure toilets for use in the squat position or to assist users to adopt the squat position. One example is disclosed in International Patent Publication No. WO 2006/137047. This document teaches a water closet comprising a platform mountable over the toilet bowl and formed with a main opening therethrough aligned with the toilet bowl, said platform being constructed to support a user in a natural squatting defecation posture over said opening and over the toilet bowl, the middle front of a said platform in front of main opening occupied by a folded pan located to serve as urinal pan when the user is in the squatting position, said pan include side and front shields which are in operative vertical position prevent urine splashing outside of the urinal pan, the side shields mounted pivotally to said platform at the borders of pan to either operative approximately vertical or inoperative horizontal position, said front shield mounted pivotally in front of urinal pan to either operative vertical or to inoperative folded on the floor of urinal pan or on the backs of side shields position, said urinal pan include ropes which are connecting with one end to outer faces of side shields and with the other end to outer face of front shield thus securing concordant transverse of front and side shields from inoperable to operable position and vice versa.

Whilst directed to overcoming the problem, this device has a number of disadvantages including its complex nature, its lack of adjustment to account for people (and toilet pedestals) of different heights, and its intrusive aesthetic nature.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to an apparatus to assist squatting on toilets, which may at least partially overcome at least one of the abovementioned disadvantages or provide the consumer with a useful or commercial choice.

With the foregoing in view, the present invention in one form, resides broadly in an apparatus for assisting a person in assumption of a beneficial position for evacuations when using a toilet, the apparatus including a platform adapted to raise a user's feet from the ground surface, the platform having at least one height adjustment means associated therewith and an opening therein to at least partially receive a portion of the toilet or bowl.

In a second form, the invention resides in a method for assisting a person in assumption of a beneficial position for evacuations when using a toilet, the method including the steps of providing a platform adapted to raise a user's feet from the ground surface, the platform having at least one height adjustment means and an opening therein to at least partially receive a portion of the toilet or bowl and positioning the platform at least partially about a toilet or bowl and adjusting the height of the platform such that a user assumes at least a partial squat position.

Use of the device of the present invention will preferably position the user's pelvis in the optimum position for evacuation, either micturition or defecation. The optimum position is forward bending, anteversion or near squat (knees above the Anterior Superior Iliac Spine (ASIS)) with a full squat more preferred, but fewer users, particularly Western users, will be physically able to assume this position. The position assumed will therefore typically be forward bending and anteverted and as close as possible to a full squat.

The device finds application with either western toilets having a pedestal extending above the ground level or Asian-style toilets in which the toilet is recessed into the ground and the opening is approximately at ground level. When used with Asian-style toilets, the device will normally be used in the fully collapsed or retracted condition and the opening of the device placed adjacent the opening of the toilet.

The apparatus of the present invention includes a platform. The platform will typically include a substantially planar upper surface. The platform will also preferably be suitably sturdy in order to maintain its shape and position under the weight of a person, even if the entire weight of the person is placed on to the platform. According to a particularly preferred invention, the platform is typically rated to 150 kg.

Normally, the upper surface of the platform will be adapted to have a user's feet placed thereon during use. The upper surface of the platform may therefore be provided with marking indicia to indicate that the "correct" position of the feet during use. There may be different indicia provided for use of the platform on by a child in contrast to use by an adult. The marking indicia may be of any form, including embossing the marking indicia onto the surface. Alternatively, the marking indicia may be depressions. Preferably, the marking indicia will be foot-shaped markings.

The platform is preferably provided with arcuate edges in order to minimise the chance of injury to a user when using the apparatus. The platform may be of any shape, although a generally rectangular shape when viewed in plan is preferred. In this form, the platform will normally have a pair of side edges, a front edge and upper and lower surfaces. The front corners of the platform will generally be rounded when viewed in plan.

The apparatus also includes at least one height adjustable means in order to adjust the separation distance of the platform from the ground or floor surface. Normally a plurality of height adjustable means will be provided. Typically, the height adjustable means are provided beneath the platform.

Preferably, a height adjustable means is provided at or adjacent to each corner of the platform and/or spaced about the platform in order to stabilise the platform, particularly during use. The height adjustable means may also be used to allow for any irregularity in the surface of the floor or ground such that the platform is maintained in a substantially horizontal orientation for use.

It is particularly preferred that the height adjustable means are fixable or lockable to at least temporarily fix the height of the platform. Normally, the height adjustable means will allow the platform to be fixed at a number of predetermined heights, such as at approximately 80 mm, approximately 150 mm, approximately 230 mm and approximately 400 mm. Normally, the maximum height at which the platform can be located will be at or slightly beneath the upper edge of the toilet bowl. Most countries have a reasonably standard height of toilet bowl and the apparatus of the invention is preferably adaptable to suit.

According to the above, locking means may be provided for each height adjustable means.

According to a particularly preferred embodiment, the height adjustable means include telescoping legs or similar. It is further preferred that the telescoping legs be provided with enlarged lower portions in order to improve stability and also to spread the load over a large area.

Alternatively, the height adjusting means may include one or more scissor-action extendible portions to raise and lower the height of the platform.

The height adjustment means will also preferably be provided with a movement prevention/safety device adapted to prevent the platform being raised or lowered if bearing a weight above a threshold limit. The threshold limit will normally be quite low particularly given that the apparatus of the present invention can be used by children.

The platform included in the present invention includes an opening to at least partially receive a portion of the toilet opening or bowl. The opening will normally be in a rear portion of the platform. The opening may have any shape, but will preferably have an at least partially arcuate portion given that most toilet bowls have a rounded appearance. The opening will normally be shaped and sized to fit a majority of toilets. A portion of the opening may in use, abut the toilet or bowl but this is not necessarily the case. However, a portion of the opening/platform will preferably abut the toilet or bowl when the platform is raised in order to stabilise the platform.

The apparatus of the invention preferably further includes a substantially planar foot portion. The foot portion preferably corresponds in size and shape to the platform. Normally, the height adjustment means are located between the foot portion and the platform, that is, preferably extend between an upper portion of the foot portion and a lower portion of the platform. According to an embodiment, a lower portion of the height adjustable means may extend partially into or through the foot portion.

According to a particularly preferred embodiment, the platform and foot portion will contain the height adjustment means when the platform is fully lowered. When fully lowered, the platform and foot portion will normally form an apparatus of approximately 80-100 mm in height.

The platform and/or the foot portion may be provided with opening(s) therein in order to receive the collapsed height adjustment means.

The platform may be provided with handles in order to assist the user with maintaining their balance on the apparatus.

It is also preferred that the apparatus of the present invention may be adapted to support the user's weight such that the user does not contact the toilet bowl or opening during use of the device.

The foot portion will also preferably have an opening to at least partially receive the toilet opening or bowl. The opening in the foot portion will preferably be shaped similarly to the opening in the platform although the openings may not necessarily have the same shape. In particular, the opening in the foot portion is preferably shaped to abut the toilet in order to assist with the correct positioning of the apparatus relative to the toilet for use.

Normally, the height adjustment means/legs are attached to both the platform and foot. Such attachment may be either temporary or permanent attachment.

The apparatus a further include one or more lifting mechanisms. In use, the lifting mechanisms will typically provide a positive lifting force for the platform in order to raise the platform above ground level should this be required. Preferably, the lifting mechanisms may be biased into an extended condition. Further, the lifting mechanisms will preferably have a locking means in order to lock the lifting mechanisms at any level or degree of extension. Although the lifting mechanisms may have any form, according to a most preferred embodiment, gas springs or a similar hydraulic ram mechanism will be used.

In use, the apparatus of the invention is placed adjacent a toilet and the platform is raised to a height which, when a user places their feet on the platform in the designated positions, the user will by default, assume at least partially squatting position in order to achieve the advantages of this position. The height of the apparatus may be adjusted to assume a more shallow or more deeply squatting position.

This adjustment can provide advantages for a number of reasons including the ability to adjust the height of the platform in order that a user to become comfortable in assuming a squat position and adjusting the depth of the squat as required.

However, some users, for example women and children, may have difficulty in achieving a full squat, even though the full squat position is most beneficial for women in particular. The adjustable nature of the invention allows a gradual increase in the depth of squat achieved. It also allows a comfortable depth squat to be assumed.

The invention preferably therefore provides an apparatus and method of use thereof which assists a user to assume three main positions, namely the "correct", semi-squat and full squat positions, but any intervening position as well due to the adjustable nature of the device. The apparatus can be adjusted to suit use by children, females and males to account for their different anatomy and idiosyncratic factors such as flexibility and comfort in different depth squat positions.

In an alternative embodiment, the apparatus of the invention includes a platform which is generally U-shaped with a central portion and a pair of lateral wings. Normally, in use, the central portion will be located in front of the toilet or bowl and each of the lateral wings to one side of the toilet or bowl.

The platform is preferably provided with one or more mounting portions extending generally downwardly from an underside of the platform. There will normally be a pair of mounting portions, one on either lateral wing. Typically, each mounting portion will extend substantially perpendicularly to the platform.

The mounting portions are preferably generally parallel to the direction which a person faces when using the device. Each mounting portion preferably allows pivotal or rotatable mounting or attachment of one or more leg assemblies to the platform.

The mounting portions also preferably mount part of a height locking assembly. Where provided, the mounting portions will preferably have at least one guide portion to guide the movement of the height locking assembly associated therewith. Typically, the guide portions will allow extension and retraction of a preferred locking rod relative to the mounting portion.

The mounting portions are typically substantially planar. They may be formed integrally with the platform or separately from the platform and attached.

The apparatus of the invention will also typically include a base. The base is generally U-shaped with a central portion and a pair of lateral legs. Normally, in use, the central portion will be located in front of the toilet or bowl and each of the lateral legs to one side of the toilet or bowl. Each of the legs will typically extend to the rear and/or front of the platform in order to provide enhanced stability for the platform, particularly when raised.

Each of the central portion and lateral legs will normally be formed from one or more members. Typically, each member will preferably be rectangular in cross-section.

The base is preferably provided with one or more mounting portions extending generally upwardly from the base. Typically, each mounting portion will extend substantially perpendicularly to the base.

The mounting portions are preferably generally parallel to the direction which a person faces when using the device. Each mounting portion preferably allows pivotal or rotatable mounting or attachment of one or more leg assemblies to the platform.

The mounting portions are typically substantially planar. They may be formed integrally with the base or separately from the base and attached.

The platform has a height adjustment means. Preferably, the height adjustment means includes at least one, and typically a pair of leg assemblies. Usually, there is one leg assembly provided on each lateral side of the apparatus, normally between each lateral leg of the base and lateral wing of the platform.

In a preferred embodiment, each leg assembly preferably has a pair of a leg members and a pair of lower leg members. Preferably, an upper end of each upper leg member and a lower end of each lower leg member is attached pivotally or rotatably to the respective mounting portion at the upper and lower ends.

Further, of the pair of upper leg members and pair of lower leg members on each lateral side of the apparatus, there will be a forward leg member and a rear leg member. The upper forward leg member and be lower forward leg member on each lateral side are preferably attached to each other as are the upper rear leg member and the lower rear leg member on each lateral side. Preferably, the forward upper and lower leg member are pivotally attached to one another such that they can hinge, preferably forwardly, during raising and lowering. Similarly, the rear upper and lower leg member are preferably pivotally attached to one another such that they can hinge, preferably rearwardly during raising and lowering.

Typically, the leg members of each of the leg assemblies will have an interlocking arrangement between them such that rotation or pivoting of one leg member consequently results in the other leg members moving as well. Typically, an interlocking tooth assembly is provided between the front and rear upper leg members and/or between the front and rear lower leg members of each leg assembly on each lateral side.

Preferably, the leg assemblies may be provided with a portion of the height locking assembly. Typically, at least one, and preferably a number of openings are provided in one or more of the leg members of each leg assembly in order to allow the height of the form to be at least temporarily locked.

Preferably, a series of openings is provided on each upper leg member. The series of openings is preferably provided in an arc.

A "home" opening is also preferably provided into a side edge of each upper and lower leg member in order to allow the platform to be locked when in a lowered condition. Preferably, an opening is defined in an edge of each leg member such that when the leg members are adjacent one another in the lowered condition they together define an opening which can be used to lock the platform in the lowered condition. Normally, one or more locking pins or rods is provided as part of the height locking mechanism and a portion of a locking pin is received in the home opening, above the lower leg member in order to prevent raising of that leg member.

A height locking mechanism is typically provided. The height locking mechanism will preferably include one or more locking rods associated with an actuation mechanism in order to move the locking rods between an engaged and disengaged condition relative to the leg members.

Preferably, the preferred locking rods are biased into an engaged condition and the locking rods must be held against the biasing force when disengaged.

Preferably, the biasing force will be effected by a spring or similar.

The preferred actuation mechanism is centrally mounted relative to the platform and preferably, on an upper side of the platform in order that the mechanism can be easily actuated immediately prior to and immediately after a person has used the device. It is preferred that the actuation mechanism be proof against accidental actuation.

The actuation mechanism preferably actuates and controls the movement of the locking rods which are preferably located below the platform. A simple mechanism is preferred. Threaded or at least partially threaded locking rods may be used in order to increase the security of the engagement and to prevent accidental dislodgement. Preferably, a pair of rods are provided, one extending in either direction into each forward upper leg member.

The actuation mechanism may preferably have a push button action. A complex operation may be required to disengage the locking rods as opposed to a simpler action for engagement in order to prevent or limit accidental disengagement but not intentional or determined disengagement of the locking rods.

The platform is generally biased into the raised position and must be forced back down into the lowered position, typically by using the user's body weight.

The actuation mechanism will typically take the form of a push button which is located in an opening in the platform. Typically, the actuation mechanism is provided adjacent to rear edge of the platform and even more preferred use the provision of the actuation mechanism adjacent to rear edge of platform in the region of the opening to at least partially receive a portion of the toilet opening or bowl. In this way, the actuation mechanism is convenient to the user.

The actuation mechanism will preferably include a substantially vertical, depressible push button or similar which reciprocates in the opening. The pushbutton will preferably be biased upwardly which corresponds to the locking rods being in the engaged condition.

The pushbutton will preferably be associated with a locking rod drive member. According to a preferred embodiment, a pair of laterally extending locking rods are provided. The locking rods extend transversely and parallel to the platform, typically on an underside of the platform. Normally, one locking rod is provided on either side of the locking rod drive member which is preferably also located underneath the platform.

Normally, each of the locking rods will be provided with tapered outer ends in order to engage one or more openings in the legs of the platform. It is preferred that each of the locking rods will also have a tapered inner end in order to engage with the locking rod drive member. Tapered ends have been found to self locate and self-guide.

Each of the locking rods is typically biased inwardly, that is into the disengaged condition. Each locking rod is preferably maintain and driven outwardly into the engaged condition by the locking rod drive member. The locking rod drive member is typically biased into the engaged condition with the biasing force of the locking rod drive member greater than the biasing force applied to the locking rods. In essence, it is preferred that when the locking rod member is moved from the engaged condition against the biasing force, the locking rods will move under the biasing force into the disengaged condition.

The locking rod drive member will preferably have a pair of angled walls or surfaces oriented on either side towards the inner end of the respective locking rods. Typically, the preferred tapered end of the locking rods will ride on the angled walls or surfaces. The angled walls or surfaces are preferably angled outwardly such that a lower portion of the locking rod drive member is wider than an upper portion.

A fixed or constant width portion may be provided at a bottom portion of the locking rod drive member. This constant width portion may be considered to function as a locking portion.

A guides or groove may be provided on each of the walls or surfaces of the locking rod drive member in order to guide the movement of the locking rods during movement and to prevent catching of the end of the locking rods.

A larger or deeper opening may be provided in an outer wall of the constant width portion in order to require more force to displace the end of the locking rods therefrom in order to move the locking rods into the unlocked condition or to prevent or minimise the chance of accidental, but not determined disengagement of the locking rods.

In use, forcing the pushbutton downwardly, will force depression of the locking rod drive member. This will firstly disengaging the ends of the rods from the locking openings and will allow the locking rods to move inwardly into the disengaged condition, under their biasing force as the force maintaining them into the engaged condition is removed or lessened through the provision of the angled walls or surfaces as the drive member moves downwardly.

Advantages of Squatting and Near Squatting

Makes elimination faster, easier and more complete. This helps prevent "fecal stagnation," a prime factor in colon cancer, appendicitis and inflammatory bowel disease.

Protects the nerves that control the prostate, bladder and uterus from becoming stretched and damaged.

Securely seals the ileocecal valve, between the colon and the small intestine. In the conventional sitting position, this valve is unsupported and often leaks during evacuation, contaminating the small intestine.

Relaxes the puborectalis muscle which normally chokes the rectum in order to maintain continence.

Uses the thighs to support the colon and prevent straining. Chronic straining on the toilet can cause hernias, diverticulosis, and pelvic organ prolapse.

A highly effective, non-invasive treatment for hemorrhoids, as shown by published clinical research.

For pregnant women, squatting avoids pressure on the uterus when using the toilet. Daily squatting helps prepare one for a more natural delivery.

Bladder function improves in the "correct" and near squat position along with the squat position by preventing stagnation.

Good foot support and elevation helps cure bowel and bladder problems in children.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
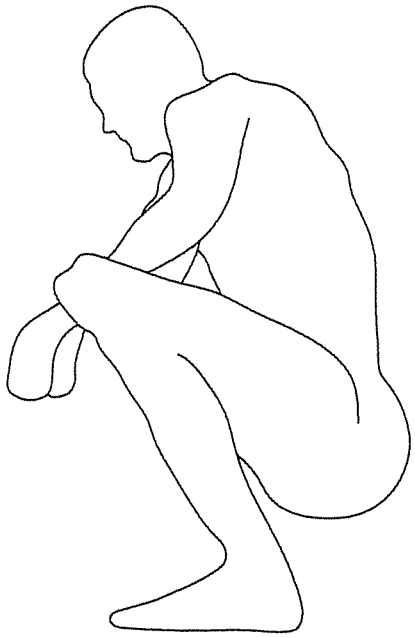
FIG. 1 (Prior Art)
FIG. 1 is a view from the side of a male in the traditional full squat position.
Figure 2:
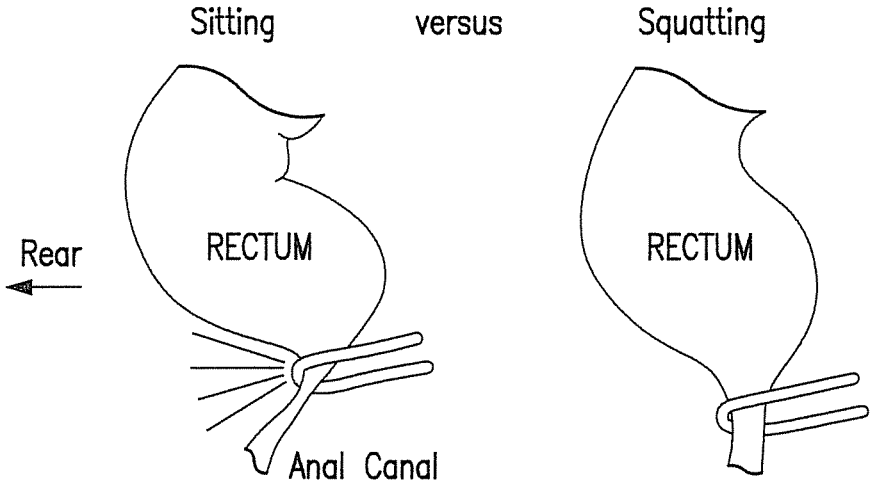
FIG. 2 is a schematic view of the difference in the position of the puborectalis muscle in the sitting position contrasted with the position in the squat position.
Figure 3:
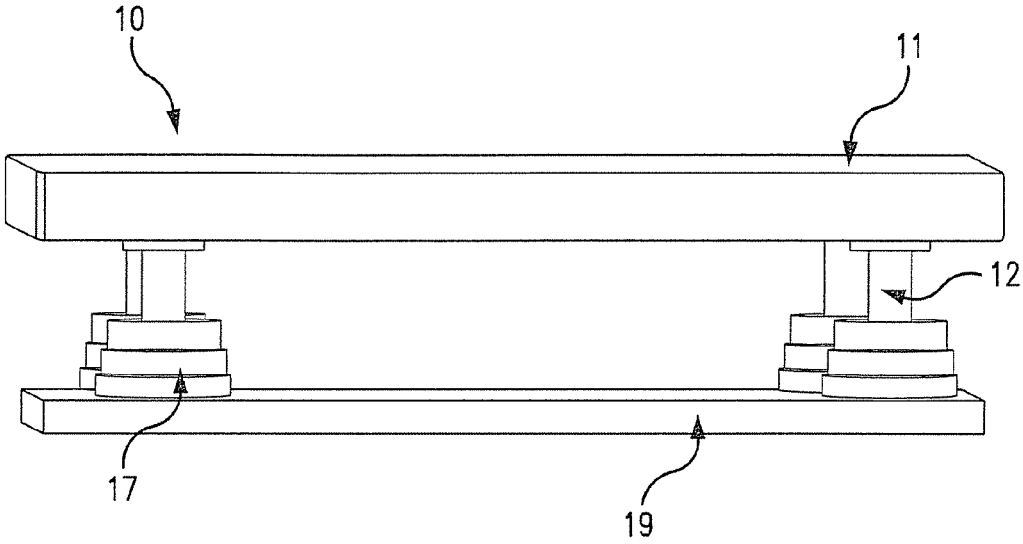
FIG. 3 is a front elevation view of an apparatus according to a preferred embodiment of the present invention in a raised condition.
Figure 4:
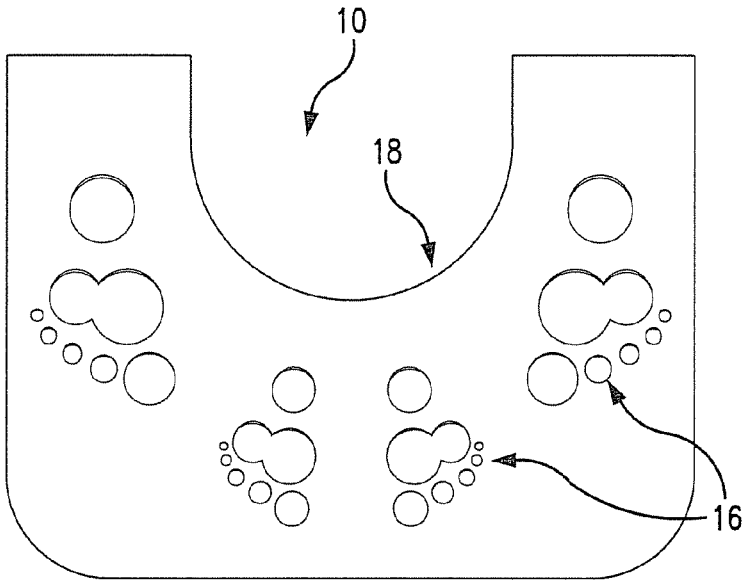
FIG. 4 is a view from above of the apparatus illustrated in FIG. 3.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

According to a particularly preferred embodiment of the present invention, an apparatus 10 for assisting a person in assumption of the near and/or full squat position for evacuations is provided.

The apparatus as illustrated in FIGS. 4 to 9 includes a platform 11 adapted to raise a user's feet from the ground surface, the platform 11 having height adjustable legs 12 associated therewith and an opening 13 therein to at least partially receive a portion of the toilet 14 or bowl 15.

The platform include a substantially planar upper surface with foot-shaped marking indicia 16 to indicate that the "correct" position of the feet during use. There are two sets of marking indicia provided for use on the platform illustrated, one set for use by a child and one set for use by an adult.

Figure 5:
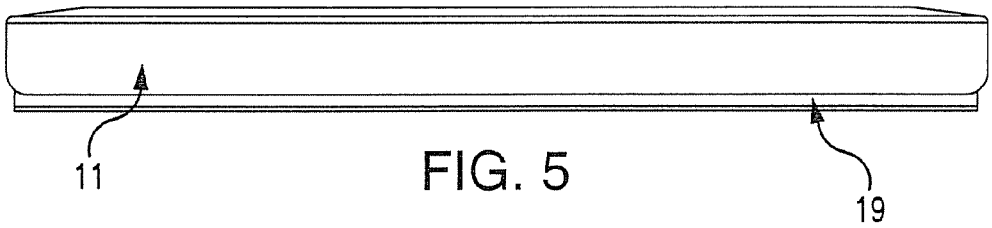
FIG. 5 is a front elevation view of the apparatus illustrated in FIG. 3 in the collapsed condition.

The platform 11 is generally rectangular shape when viewed in plan having a pair of side edges, a front edge and upper and lower surfaces. The front corners of the platform 11 will generally be rounded when viewed in plan as illustrated in FIG. 5 in particular.

The apparatus also includes a plurality of height adjustable legs 12 in order to adjust the separation distance of the platform 11 from the ground or floor surface. A leg 12 is provided at or adjacent to each corner of the platform 11 in order to stabilise the platform 11, particularly during use.

Figure 19:
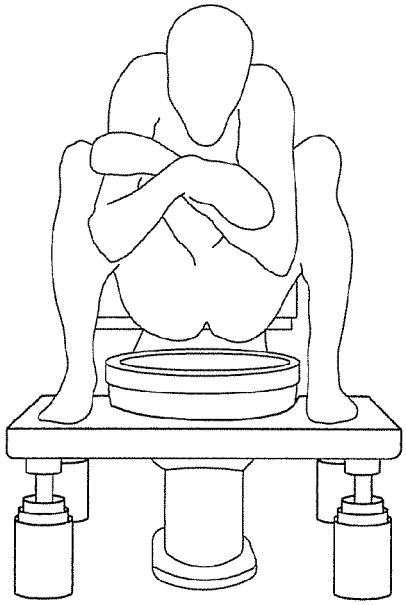
FIG. 19 is a front elevation view of a male seated on a toilet and using the device illustrated in FIG. 18.
Figure 20:
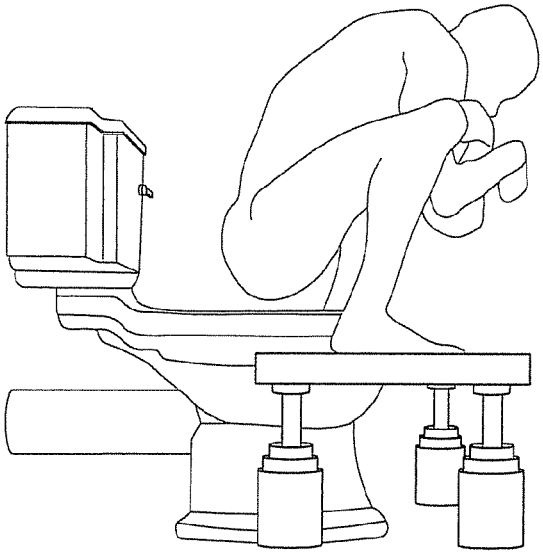
FIG. 20 is a side elevation view of a male seated on a toilet and using the device illustrated in FIGS. 18 and 19.
Figure 21:
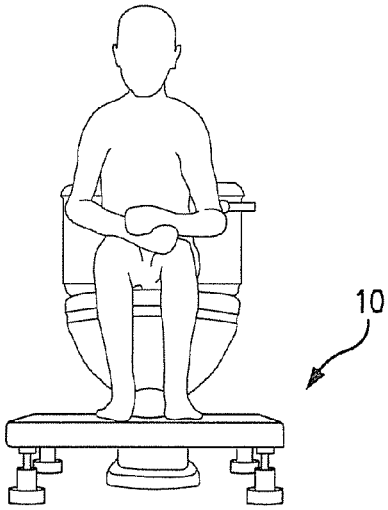
FIG. 21 is a front elevation view of a child seated on a toilet and using a device according to a fifth preferred embodiment of the present invention.
Figure 22:
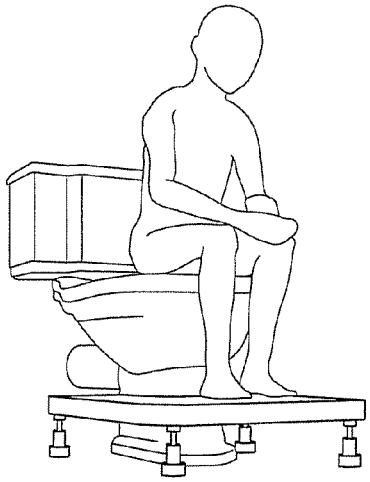
FIG. 22 is a perspective view of a child seated on a toilet and using the device illustrated in FIG. 21.
Figure 23:
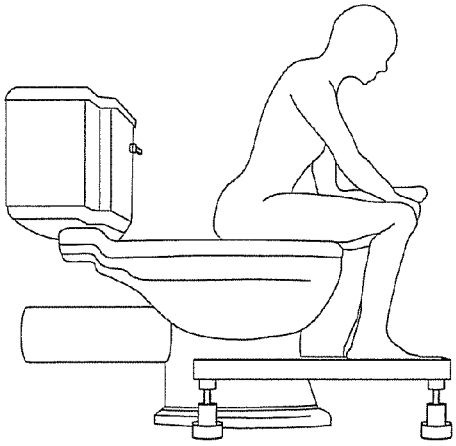
FIG. 23 is a side elevation view of a child seated on a toilet and using the device illustrated in FIGS. 21 and 22.
Figure 24:
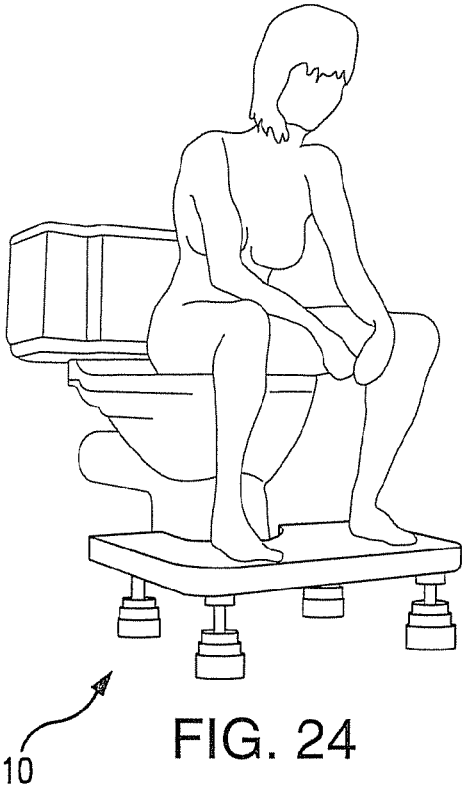
FIG. 24 is a perspective view of a female seated on a toilet and using a device according to a sixth preferred embodiment of the present invention.
Figure 25:
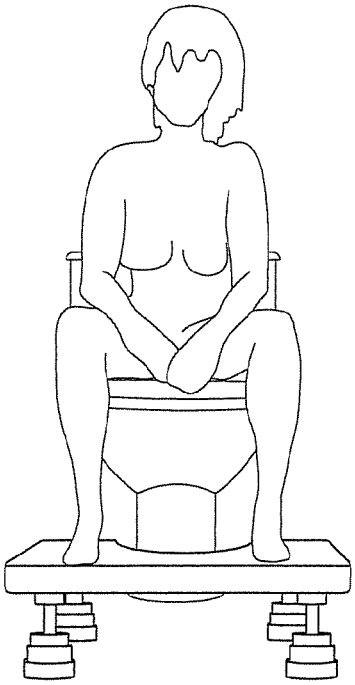
FIG. 25 is a front elevation view of a female seated on a toilet and using the device illustrated in FIG. 24.
Figure 26:
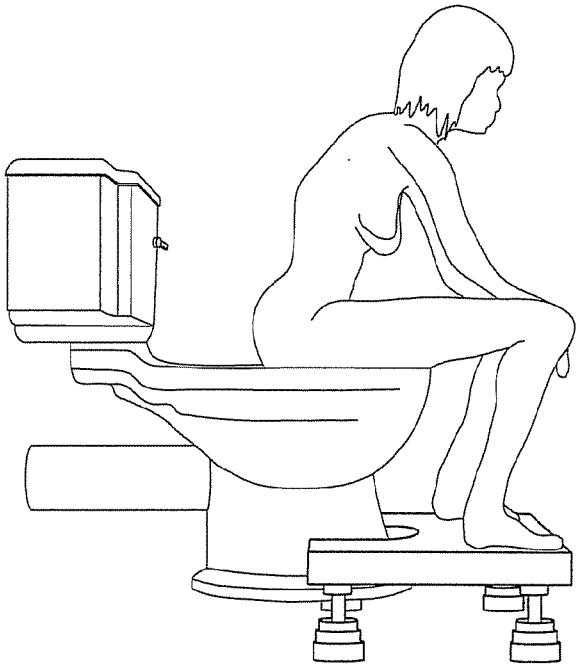
FIG. 26 is a side elevation view of a female seated on a toilet and using the device illustrated in FIGS. 24 and 25.
Figure 27:
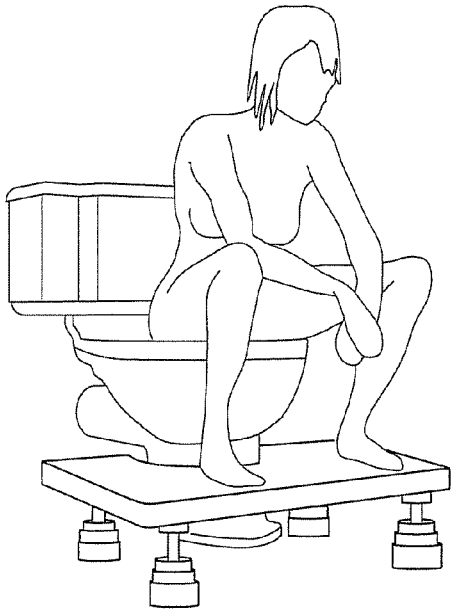
FIG. 27 is a perspective view of a female seated on a toilet and using a device according to a seventh preferred embodiment of the present invention.
Figure 28:
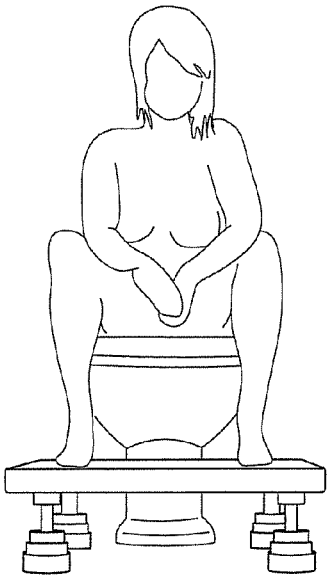
FIG. 28 is a front elevation view of a female seated on a toilet and using the device illustrated in FIG. 27.
Figure 29:
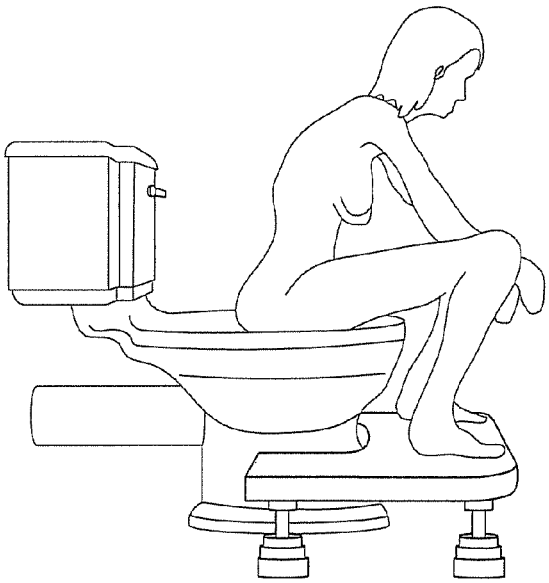
FIG. 29 is a side elevation view of a female seated on a toilet and using the device illustrated in FIGS. 27 and 28.
Figure 30:
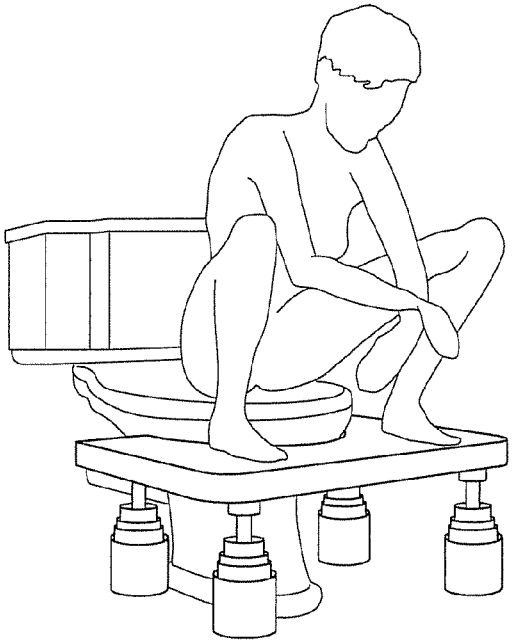
FIG. 30 is a perspective view of a female seated on a toilet and using a device according to a eighth preferred embodiment of the present invention.
Figure 31:
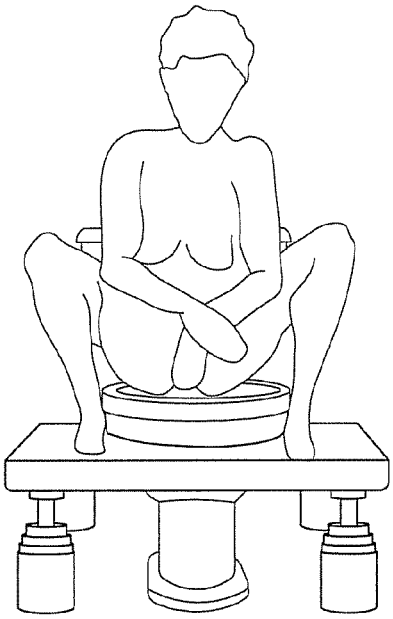
FIG. 31 is a front elevation view of a female seated on a toilet and using the device illustrated in FIG. 30.
Figure 32:
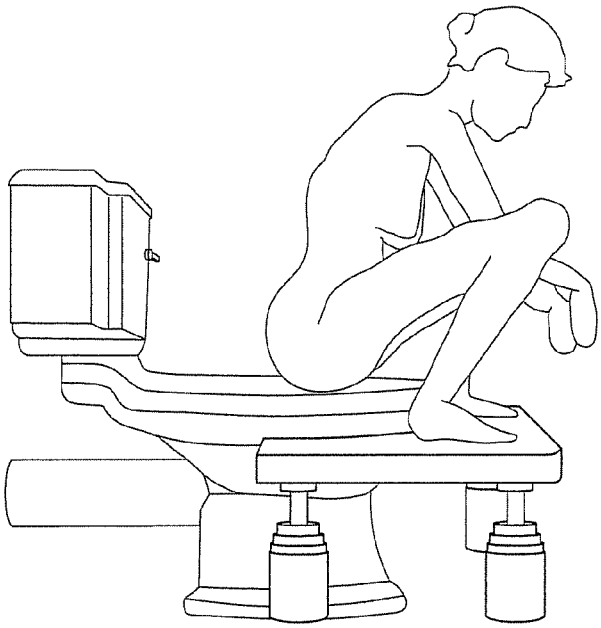
FIG. 32 is a side elevation view of a female seated on a toilet and using the device illustrated in FIGS. 30 and 31.
Figure 33:
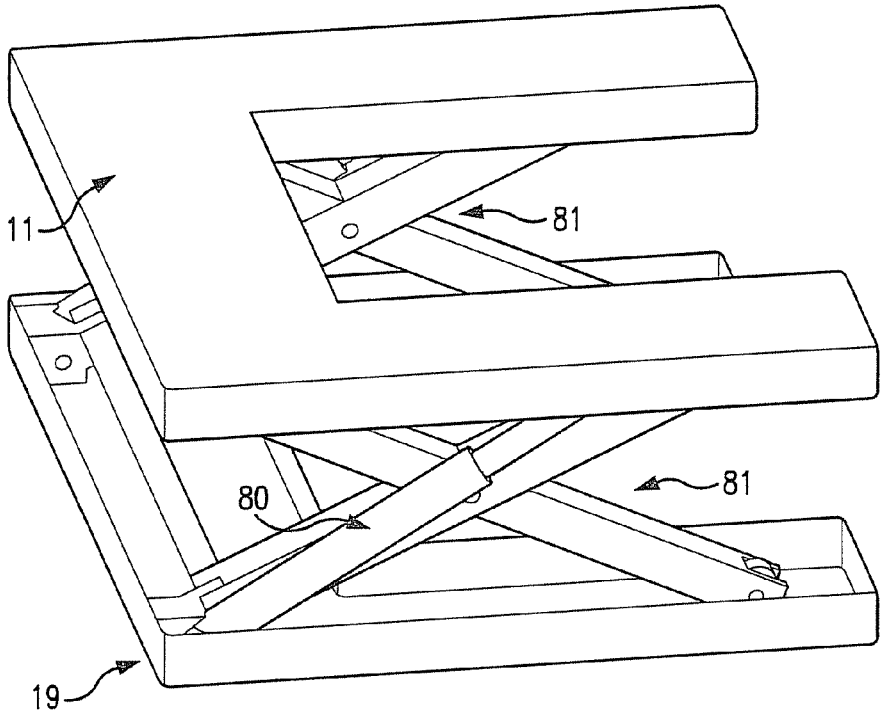
FIG. 33 is a perspective view from the side from slightly above of a device of a further preferred embodiment.
Figure 34:
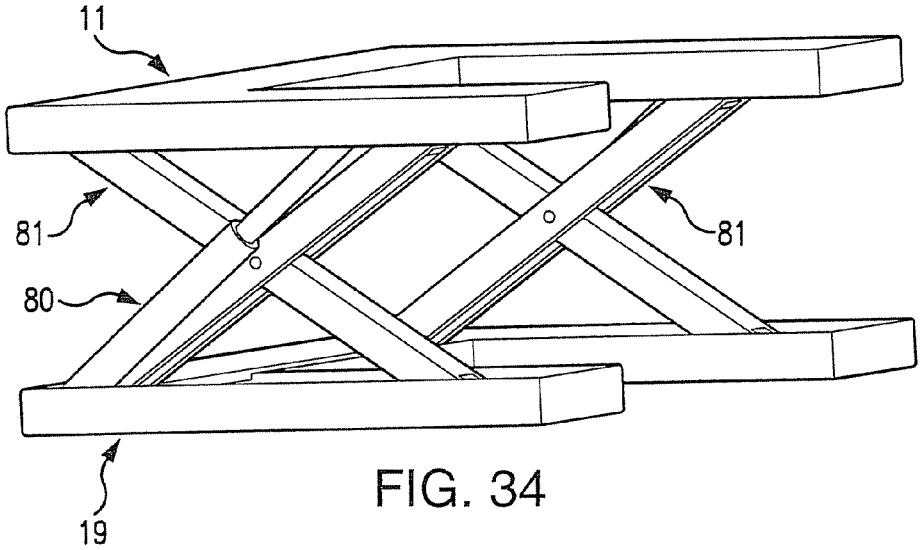
FIG. 34 is a perspective view from the side from slightly behind of a device as illustrated in FIG. 33.
Figure 35:
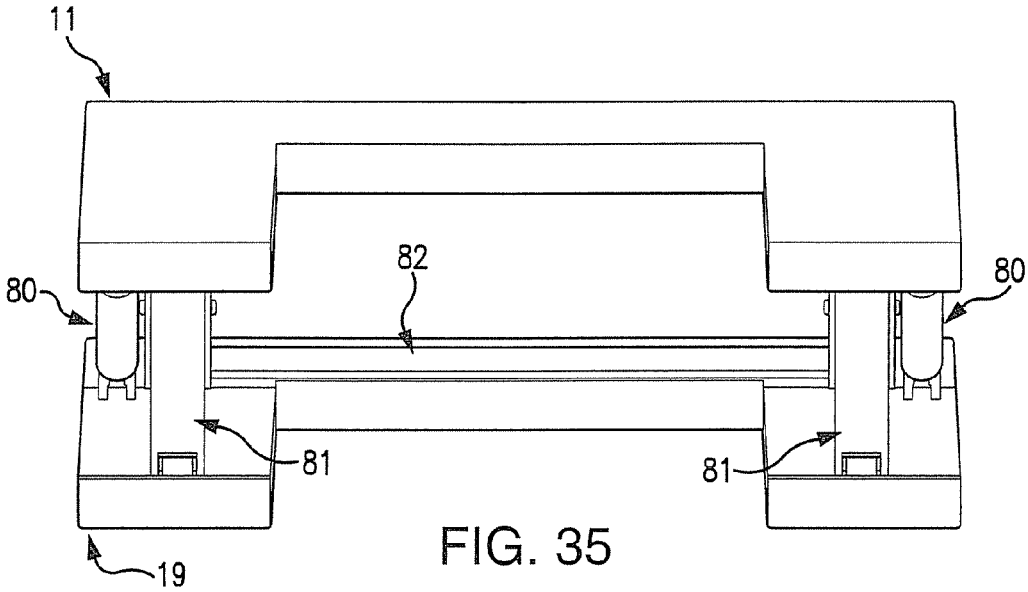
FIG. 35 is a front view of the device as illustrated in FIG. 3334.
Figure 36:
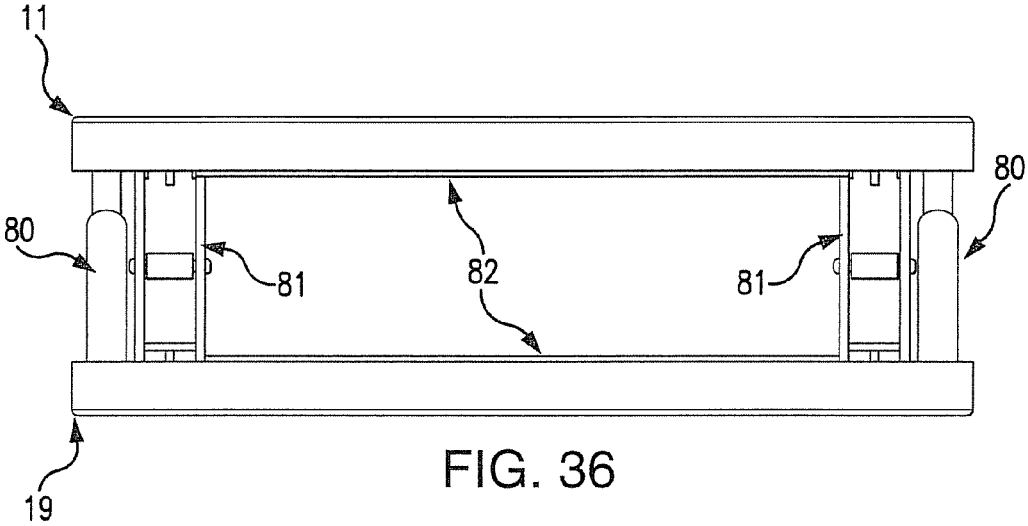
FIG. 36 is a rear view of the device as illustrated in FIG. 33.
Figure 37:
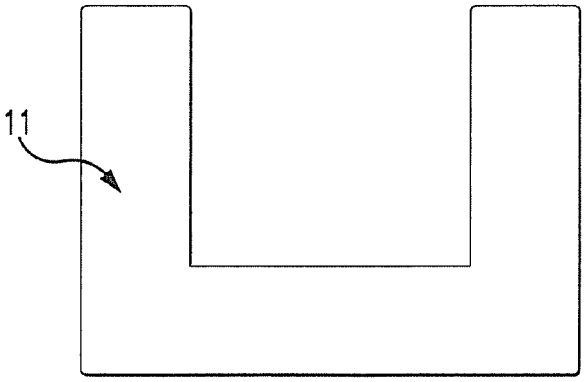
FIG. 37 is a top view of the device as illustrated in FIG. 33.

It is particularly preferred that the legs 12 are lockable to at least temporarily fix the height of the platform 11. Normally, the height adjustable legs of the preferred embodiment allows the platform 11 to be fixed at a number of predetermined heights, such as at approximately 80 mm, approximately 150 mm, approximately 230 mm and approximately 400 mm as are illustrated in FIGS. 10 to 33. Normally, the maximum height at which the platform can be located will be slightly beneath the upper edge of the toilet bowl as illustrated in FIGS. 19 to 21.

According to the illustrated embodiment, the height adjustable legs 12 are telescoping legs with enlarged lower portions 17 in order to improve stability and also to spread the load over a large area. The height adjustment is important as in a recent trial of the device of the present invention, only two thirds of women and children could actually perform a full squat.

Although not illustrated, the height adjustment legs of the illustrated embodiment are also provided with a safety device adapted to prevent the platform 11 being raised or lowered if bearing a weight above a threshold limit.

The platform 11 included in the present invention includes an opening 13 to receive a portion of the toilet pedestal 14 or bowl 15. The opening 13 is in a rear portion of the platform 11. The opening 13 is shaped and sized to fit a majority of toilets. A forward edge of the opening 18 abuts the toilet pedestal 14 or bowl 15 particularly when the platform 11 is raised in order to stabilise the platform 11.

The illustrated apparatus further includes a substantially planar foot 19. The foot 19 corresponds in size and shape to the platform 11. The platform 11 is provided with openings therein in order to receive the collapsed height adjustment legs 12. The height adjustment legs 12 are located between the foot portion 19 and the platform 11, that is, the legs 12 extend between an upper portion of the foot 19 and the platform 11.

Figure 6:
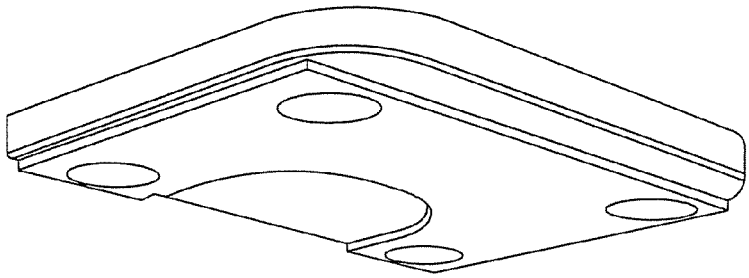
FIG. 6 is a perspective view from below of the apparatus illustrated in FIG. 5.
Figure 7:
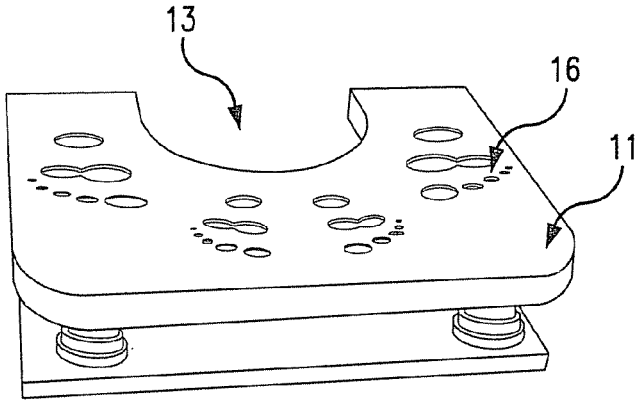
FIG. 7 is a perspective view from above of the apparatus illustrated in FIG. 3.
Figure 8:
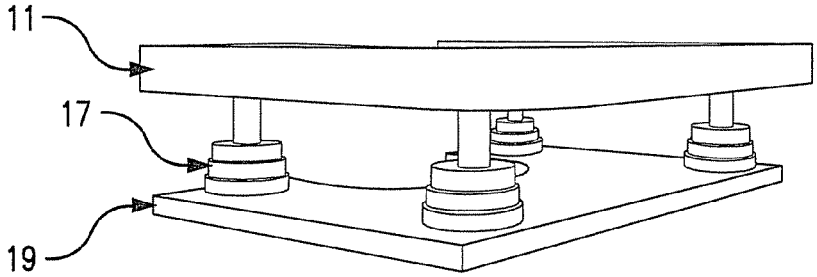
FIG. 8 is a view from the side of the apparatus illustrated in FIG. 3.
Figure 9:
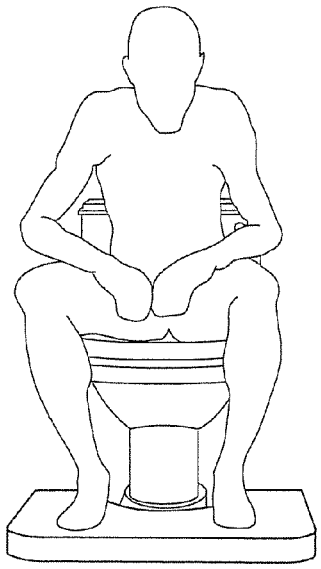
FIG. 9 is a front elevation view of a male seated on a toilet and using a device according to a first preferred embodiment of the present invention.
Figure 10:
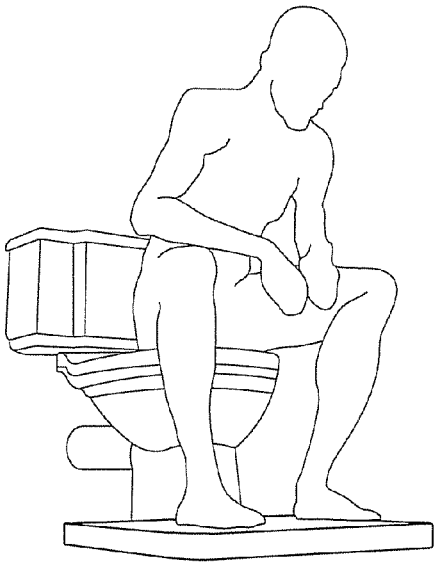
FIG. 10 is a perspective view of a male seated on a toilet and using the device illustrated in FIG. 9.
Figure 11:
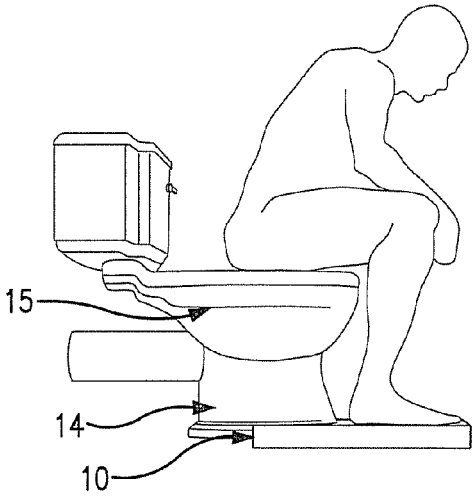
FIG. 11 is a side elevation view of a male seated on a toilet and using the device illustrated in FIGS. 9 and 10.
Figure 12:
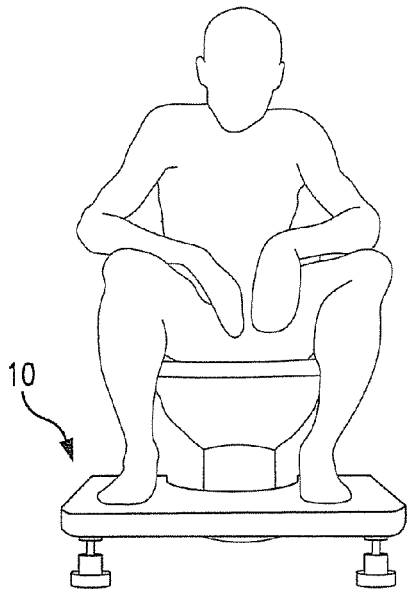
FIG. 12 is a front elevation view of a male seated on a toilet and using a device according to a second preferred embodiment of the present invention.
Figure 13:
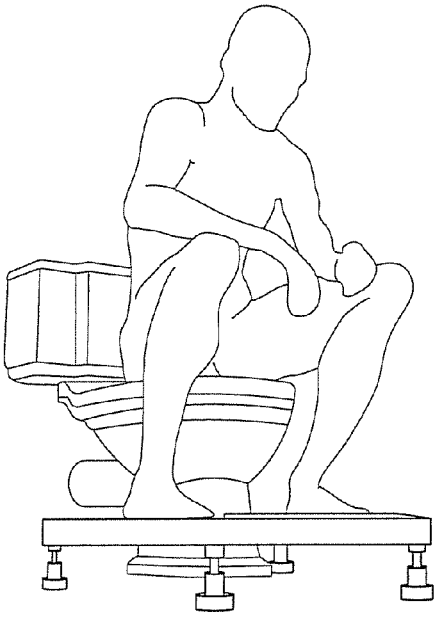
FIG. 13 is a perspective view of a male seated on a toilet and using the device illustrated in FIG. 12.
Figure 14:
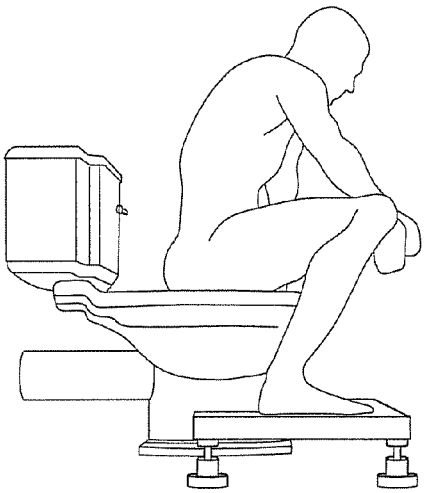
FIG. 14 is a side elevation view of a male seated on a toilet and using the device illustrated in FIGS. 12 and 13.
Figure 15:
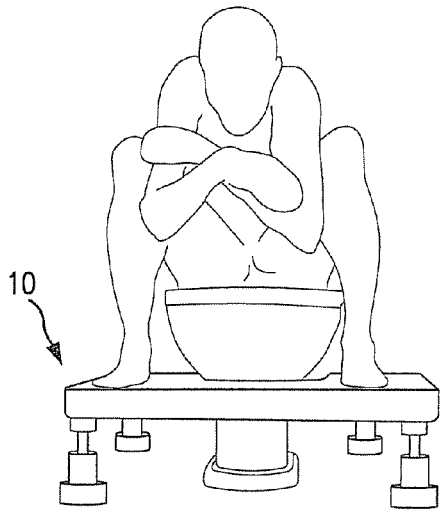
FIG. 15 is a front elevation view of a male seated on a toilet and using a device according to a third preferred embodiment of the present invention.
Figure 16:
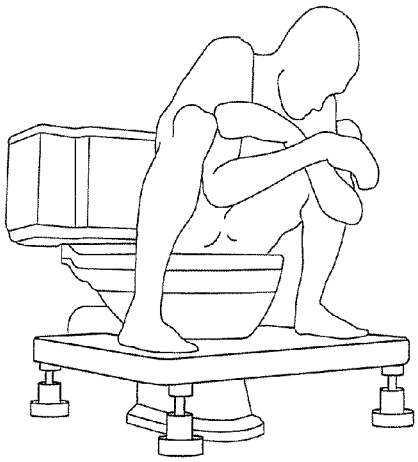
FIG. 16 is a perspective view of a male seated on a toilet and using the device illustrated in FIG. 15.
Figure 17:
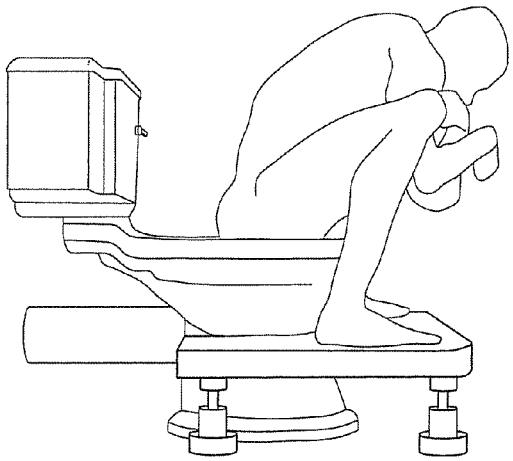
FIG. 17 is a side elevation view of a male seated on a toilet and using the device illustrated in FIGS. 15 and 16.
Figure 18:
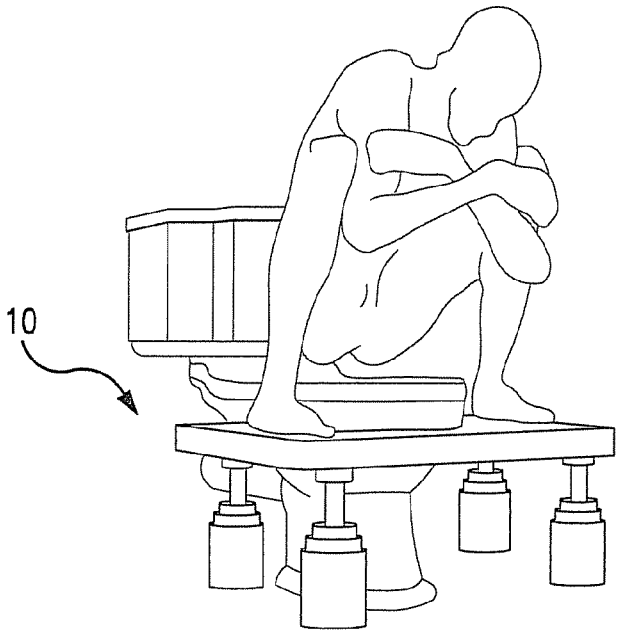
FIG. 18 is a perspective view of a male seated on a toilet and using a device according to a fourth preferred embodiment of the present invention.

According to a particularly preferred embodiment, the platform 11 and foot 19 contain the height adjustment legs 12 when the platform 11 is fully lowered. When fully lowered, the platform and foot portion will normally form an apparatus of approximately 80-100 mm in height as illustrated in FIGS. 6 and 7.

The foot 19 also has an opening to at least partially receive the toilet pedestal 14 or bowl 15. The opening in the foot 19 of the illustrated embodiment is shaped similarly to the opening 13 in the platform 11.

An alternative device is illustrated in FIGS. 33 to 37. The approximate dimensions of the illustrated device are:

Minimum height: 80 mm
Maximum height: 400 mm
Width: 690 mm
Length: 510 mm
Footrest width: 151 mm The vertical elevation of the device can be adjusted anywhere between 80 mm and 400 mm. (400 mm being the global standard height for toilet seats).

Two gas springs 80 are used to balance the load the user on the device. Only one gas spring 80 is lockable, thus avoiding the tilting of the device that could occur due to mismatch in locking of the 2 gas springs 80 at a later point of time.

Mild steel has been used for the fabrication of the alpha prototype in order to produce a low cost initial prototype and test the concept of the design. Nylon has been used for the rollers for the scissor legs in order to minimize friction and have a smooth sliding operation.

After a sufficient and satisfactory testing cycle, PVC can be used for the upper and lower plates with a 5 mm rubber surface at the bottom to avoid the lateral movement of the device when being used. PVC was selected basically because of the following reasons:

1>Water resistant
2>Ease of moulding into complex shapes.

The main difference with the embodiment illustrated in FIGS. 33 to 37 is the inclusion of the scissor mechanism legs 81 between the foot 19 and the platform 11 and the inclusion of the gas springs 80. The gas springs 80 are biased into the extended configuration and may be forced into the retracted configuration through the application of sufficient force once the gas springs 80 have been unlocked.

The legs are typically baced against lateral movement by the provision of crosspieces 82 extending between the legs at an upper and lower point. These crosspieces may also be used to attach the platform 11 and the foot 19 to the scissor legs 81.

The gas springs 80 are lockable at any measure of extension and upon unlocking will tend to a fully extended condition, unless force is applied to retract the gas springs 80.

It can be seen from the embodiment illustrated in FIGS. 33 to 37 that the gas springs 80 of the illustrated embodiment extend at an angle between the foot 19 and the platform 11. Each of the respective ends of the gas springs 80 will preferably be pivotally attached to the foot 19 and the platform 11. This will allow the device to be decreased in height much more than if the gas springs 80 were provided in a substantially vertical orientation.

It is also evident from the illustrated embodiment of the gas springs are oriented substantially parallel to one of the legs of the scissor mechanism. This may provide additional support and stability to the device.

Figure 38:
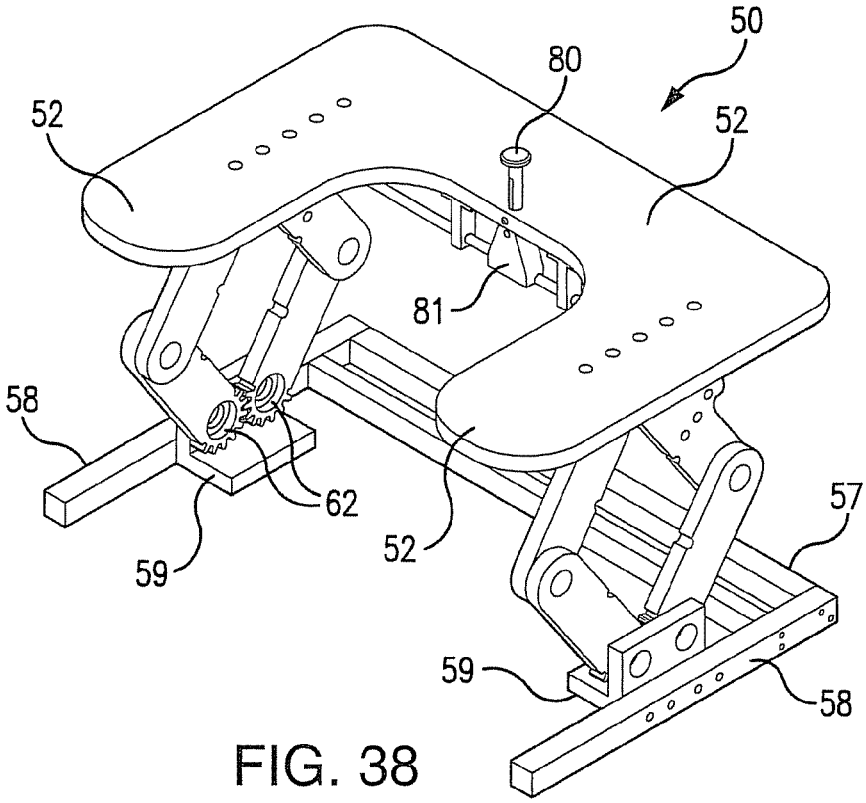
FIG. 38 is an isometric view of an alternative embodiment of the apparatus of the present invention.
Figure 39:
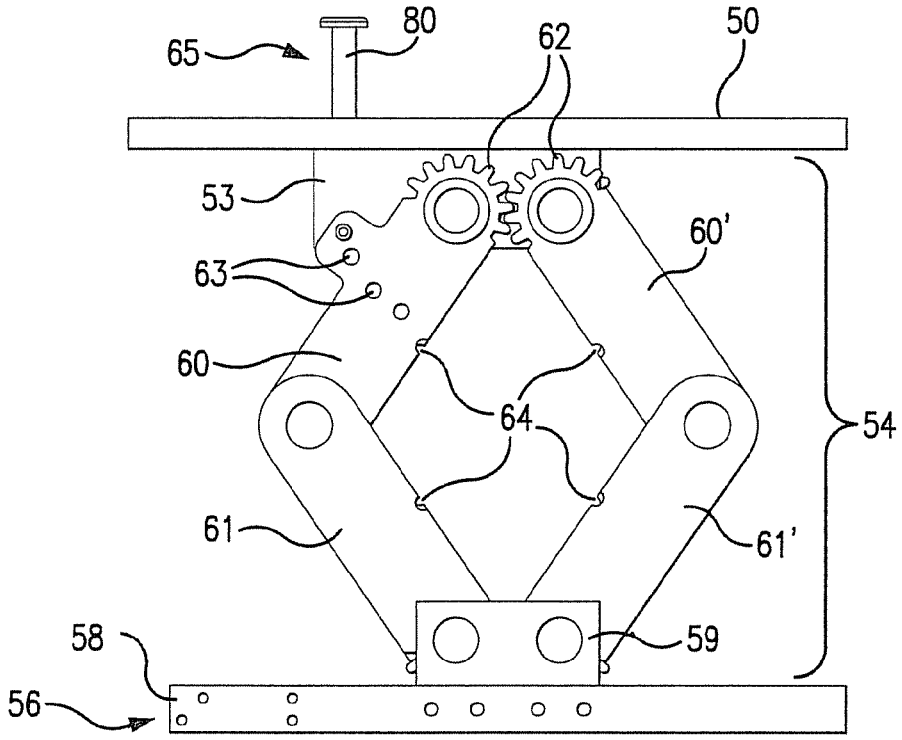
FIG. 39 is a side elevation view of the embodiment illustrated in FIG. 38.
Figure 40:
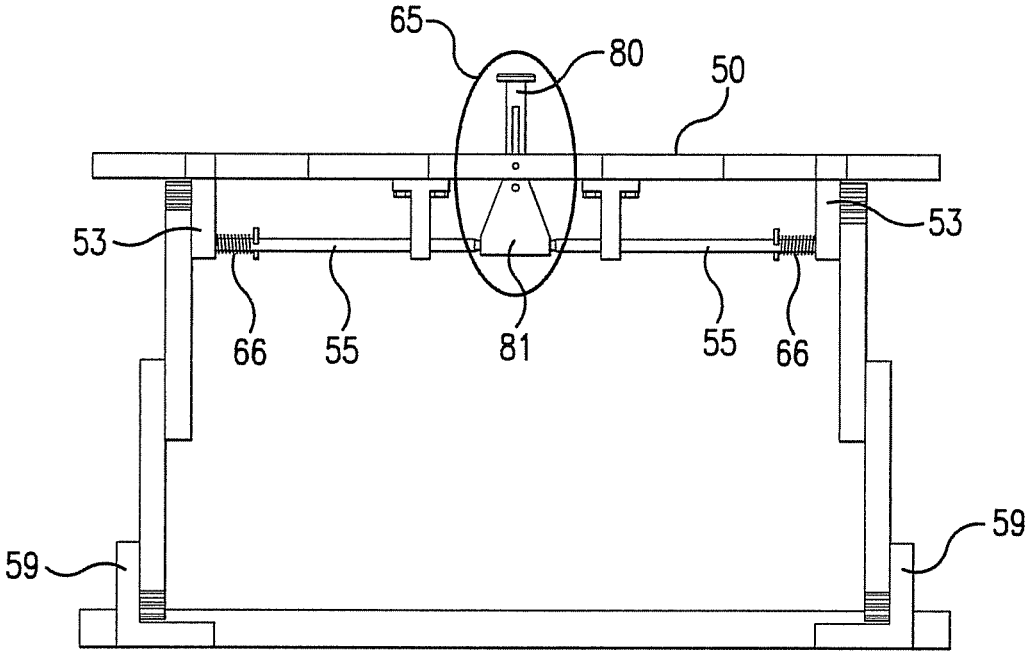
FIG. 40 is a front elevation view of the embodiment illustrated in FIG. 38.

In the alternative embodiment illustrated in FIGS. 38 to 40, the invention includes a platform 50 which is generally U-shaped with a central portion 51 and a pair of lateral wings 52. Normally, in use, the central portion is located in front of the toilet or bowl and each of the lateral wings 52 to one side of the toilet or bowl.

The platform 50 is provided with a pair of mounting portions 53, one on either lateral wing 52, each extending generally downwardly from an underside of the platform 50. Each mounting portion 53 extends substantially perpendicularly to the platform 50.

The mounting portions are preferably generally parallel to the direction of person faces when using the device. Each mounting portion allows pivotal or rotatable mounting or attachment of a leg assembly 54 to the platform 50.

The mounting portions 52 have at least one guide opening to guide the movement of a height locking assembly associated therewith allowing extension and retraction of a preferred locking rod 55 relative to the mounting portion.

The base 56 is generally U-shaped with a central portion 57 and a pair of lateral legs 58. Normally, in use, the central portion 57 will be located in front of the toilet or bowl and each of the lateral legs 58 to one side of the toilet or bowl. Each of the legs 58 will typically extend to the rear and/or front of the platform 50 in order to provide enhanced stability for the platform, particularly when raised.

The base is preferably provided with a pair of mounting portions 59 extending generally upwardly from the base 59. Typically, each mounting portion 59 will extend substantially perpendicularly to the base 56.

The mounting portions 59 are preferably generally parallel to the direction of person faces when using the device. Each mounting portion 59 preferably allows pivotal or rotatable mounting or attachment of a leg assembly 54 to the platform 50.

The apparatus has a height adjustment means. Preferably, the height adjustment means includes a pair of leg assemblies 54, one leg assembly 54 provided on each lateral side of the apparatus, normally between each lateral leg 58 of the base 56 and lateral wing 52 of the platform 50.

In the illustrated embodiment, each leg assembly 54 has a pair of upper leg members 60, 60' and a pair of lower leg members 61, 61'. The end of each upper leg member 60, 60' and a lower end of each lower leg member 61, 61' is attached pivotally or rotatably to the respective mounting portion at the upper and lower ends.

Further, of the pair of upper leg members and pair of lower leg members on each lateral side of the apparatus, there will be a forward leg member 60, 61 and a rear leg member 60', 61'. The upper forward leg member 60 and the lower forward leg member 61 on each lateral side are preferably attached to each other as are the upper rear leg member 60' and the lower rear leg member 61' on each lateral side.

Preferably, the forward upper 60 and lower leg member 61 are pivotally attached to one another such that they can hinge forwardly during raising and lowering. Similarly, the rear upper and lower leg member are pivotally attached to one another such that they hinge rearwardly during raising and lowering.

Typically, the leg members of each of the leg assemblies will have an interlocking arrangement between them such that rotation or pivoting of one leg member consequently results in the other leg members moving as well. In the illustrated embodiment, an interlocking tooth assembly 62 is provided between the front and rear upper leg members and between the front and rear lower leg members of each leg assembly 55 on each lateral side.

A series of openings 63 is provided on each upper leg member 60, 60' in an arc.

A "home" opening is also preferably provided into a side edge of each upper and lower leg member in order to allow the platform to be locked when in a lowered condition. According to the embodiment illustrated, a home opening 64 is defined in an edge of each leg member such that when the leg members are adjacent one another in the lowered condition they together define an opening which can be used to lock the platform in the lowered condition. Normally, a portion of the locking rod 55 is received in the home opening 64, above the lower leg member in order to prevent raising of that leg member.

A height locking mechanism is typically provided. The height locking mechanism includes a pair of locking rods 55 associated with an actuation mechanism 65 in order to move the locking rods 55 between an engaged and disengaged condition relative to the leg members.

The locking rods 55 are biased into an engaged condition and the locking rods 55 must be held against the biasing force when disengaged. The biasing force is effected by a spring 66.

The preferred actuation mechanism 65 is centrally mounted relative to the platform 50 and preferably, on an upper side of the platform 50 in order that the mechanism can be easily actuated immediately prior to, and immediately after, a person has used the device.

The actuation mechanism 65 preferably actuates and controls the movement of the pair of locking rods 55 which are preferably located below the platform 50, one extending in either direction into each forward upper leg member.

The actuation mechanism 65 of the embodiment illustrated in FIGS. 38 to 40 includes a push button 80 which is located in an opening in the platform 50.

The push button 80 is a substantially vertical, depressible push button which reciprocates in the opening in the platform. The pushbutton 80 is biased upwardly which corresponds to the locking rods 55 being in the engaged condition.

The pushbutton 80 is associated with a locking rod drive member 81. According to the illustrated embodiment, a pair of laterally extending locking rods 55 are provided. The locking rods 55 extend transversely and parallel to the platform 50, underneath the platform 50. Normally, one locking rod 55 is provided on either side of the locking rod drive member 81 which is also located underneath the platform.

Normally, each of the locking rods 55 is provided with tapered outer ends in order to engage one or more openings 63 in the legs 60. Each of the locking rods 55 also have a tapered inner end in order to engage with the locking rod drive member 81.

Each of the locking rods 55 is biased inwardly, that is into the disengaged condition by a spring 66. Each locking rod 55 is preferably maintained and driven outwardly into the engaged condition by the locking rod drive member 81. The locking rod drive member 81 is biased into the engaged condition with the biasing force of the locking rod drive member 81 greater than the biasing force applied to the locking rods 55. In essence, it is preferred that when the locking rod drive member 81 is moved from the engaged condition against the biasing force, the locking rods 55 will move under the biasing force into the disengaged condition.

The locking rod drive member 81 has a pair of angled walls or surfaces oriented on either side towards the inner end of the respective locking rods 55. The tapered end of the locking rods 55 rides on the angled walls or surfaces during movement of the drive member 81. The angled walls or surfaces are preferably angled outwardly such that a lower portion of the locking rod drive member is wider than an upper portion.

A fixed or constant width portion is provided at a bottom portion of the locking rod drive member 81. This constant width portion may be considered to function as a locking portion.

In use, forcing the pushbutton 80 downwardly will force depression of the locking rod drive member 81. This will firstly disengage the ends of the locking rods 55 from the locking openings and will allow the locking rods 55 to move inwardly into the disengaged condition, under their biasing force as the force maintaining them into the engaged condition is removed or lessened through the provision of the angled walls or surfaces as the drive member 81 moves downwardly.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus for assisting a person in assumption of a squat position for evacuations when using a toilet, the apparatus including a platform adapted to raise a user's feet from the ground surface, the platform having at least one height adjustment assembly associated therewith and an opening therein to at least partially receive a portion of the toilet or bowl, the height adjustment assembly including a pair of upper legs and a pair of lower legs on each lateral side of the platform, the upper and lower legs on each respective lateral side associated with each other pivotally, each of the pair of upper legs on each lateral side associated with the other of the pair via an interleaved tooth assembly, each of the pair of lower legs on each lateral side associated with the other of the pair via an interleaved tooth assembly, and a locking mechanism to at least temporarily fix the height of the platform.

2. An apparatus according to claim 1 wherein an upper surface of the platform is provided with marking indicia to indicate that the "correct" position of a user's feet during use.

3. An apparatus according to claim 2 wherein at least two sets of different indicia are provided, for use of the platform by a child and an adult.

4. An apparatus according to claim 1 wherein the marking indicia include foot-shaped markings.

5. An apparatus according to claim 1 wherein the height adjustable assembly allows the platform to be fixed at a number of predetermined heights to position a user in a semi-squat, near full squat or full squat position.

6. An apparatus according to claim 1 wherein the maximum height at which the platform can be located is at or slightly beneath the upper edge of the toilet bowl.

7. An apparatus according to claim 1 further including a substantially planar foot portion of a shape substantially similar to the platform and to which the height adjustable assembly is attached.

8. An apparatus according to claim 7 wherein the height adjustment assembly is located between the foot portion and the platform.

9. An apparatus according to claim 7 wherein the platform and foot portion contain the height adjustment assembly when the platform is fully lowered.

10. An apparatus according to claim 1 wherein a locking mechanism is provided to at least temporarily lock extension or retraction of the at least one length adjustable assembly.

11. A method for assisting a person in assumption of a squat position for evacuations when using a toilet, the method including the steps of providing a platform adapted to raise a user's feet from the ground surface, the platform having at least one height adjustment assembly including a pair of upper legs and a pair of lower legs on each lateral side of the platform, the upper and lower legs on each respective lateral side associated with each other pivotally, each of the pair of upper legs on each lateral side associated with the other of the pair via an interleaved tooth assembly, each of the pair of lower legs on each lateral side associated with the other of the pair via an interleaved tooth assembly, and a locking mechanism to at least temporarily fix the height of the platform and an opening therein to at least partially receive a portion of the toilet or bowl and positioning the platform at least partially about a toilet pedestal or bowl and adjusting the height of the platform such that a user assumes at least a partial squat position.

12. An apparatus according to claim 1 wherein the height of the platform is adjustable to position a user in a semi-squat, near full squat or full squat position.

13. An apparatus according to claim 1 wherein the locking mechanism includes at least one laterally extending rod to engage with an upper leg of the height adjustment assembly and biased away from the upper leg and a depressible member provided through the platform biased into a raised condition which drives the at least one laterally extending rod outwardly to engage the upper leg to at least temporarily fix the height of the platform.

14. An apparatus according to claim 13 wherein depression of the depressible member allows the at least one laterally extending rod to move away from the upper leg to allow movement of the height adjustable assembly.

15. An apparatus as claimed in claim 13 wherein the at least one laterally extending rod engages with an opening provided in an upper leg of the height adjustment assembly.

* * * * *